United States Patent [19]

Telecemian

[11] Patent Number: 4,663,865

[45] Date of Patent: May 12, 1987

[54] SPORT SHOES

[75] Inventor: Alberto Telecemian, Buenos Aires, Argentina

[73] Assignee: Iwo Cilicia S.A.C.I.F.I.A., Buenos Aires, Argentina

[21] Appl. No.: 889,604

[22] Filed: Jul. 28, 1986

Related U.S. Application Data

[63] Continuation of Ser. No. 717,217, Mar. 28, 1985, abandoned.

[30] Foreign Application Priority Data

Jan. 14, 1985 [AR] Argentina ..... 299237

[51] Int. Cl.[4] ..... A43B 5/00

[52] U.S. Cl. ..... 36/114; 36/30 R; 36/17 R

[58] Field of Search ..... 36/103, 25 R, 28, 30 R, 36/3 A, 114, 91, 102, 32 R, 12, 14, 17 R, 19.5, 22 R

[56] References Cited

U.S. PATENT DOCUMENTS

| | | | |
|---|---|---|---|
| 2,725,645 | 12/1955 | Scala | 36/30 R X |
| 3,273,265 | 9/1966 | Reinert et al. | 36/30 R X |
| 4,020,569 | 5/1977 | Fukuoka | 36/30 R X |
| 4,041,618 | 8/1977 | Famolare, Jr. | 36/25 R |

FOREIGN PATENT DOCUMENTS

| | | | |
|---|---|---|---|
| 2328325 | 12/1974 | Fed. Rep. of Germany | 36/103 |
| 1139225 | 2/1957 | France | 36/25 R |

*Primary Examiner*—Henry S. Jaudon
*Assistant Examiner*—T. Graveline
*Attorney, Agent, or Firm*—Beveridge, DeGrandi & Weilacher

[57] ABSTRACT

An improved sports shoe having a cavity throughout the outer sole which is secured to the shoe body. The outer sole has a maximum thickness at its heel, which thickness is gradually reduced as it reaches the plantar region of the shoe. A network of spaced ribs integral with the outer sole is located between the heel portion and the plantar region of the shoe and defines a bearing surface for a microporous of microcellular resilient cushion material of a thickness greater than 7 mm which is placed on such surface. A second series of ribs, also integral with the outer sole and having a height greater than the ribs of the network, is located at the shank area of the shoe to also form a bearing surface for the microporous cushion material and to support the arch of the wearer's foot. Also disclosed is a method for forming the sports shoe wherein a last having a volume larger than the volume of the last usually used for a shoe of the same size is utilized so as to form additional space at the bottom of the shoe for the insertion of the microporous cushion layer of a thickness of at least 7 mm and an insole lining secured to the cushion layer.

5 Claims, 5 Drawing Figures

SPORT SHOES

This application is a continuation of application Ser. No. 717,217, filed Mar. 28, 1985, now abandoned,

DESCRIPTION

This invention pertains to improvements in sport shoes and its purpose is to offer an extremely positive means for the fulfillment of its specific task as a foot covering, giving a comfortable and safe gait or stride which is neither damaging to the wearers anatomy or body nor causing him discomfort.

By sport shoes is meant shoes comprising a toecap—generally with overlapped or tongue between lapels or flaps fastening the foot instep, with holes for shoelaces, adherent strips, etc.—side walls 1*a* heelpiece and a flexible sole of wear resistant and antislipping material, bounding the foot volume following the contour of its plantar region and being completed with a surrounding welt. This shoe is called "sport shoe" so as to clearly distinguish it from the leather and sole shoe used to look smart or from the ordinarily termed "slipper", used indistinguishably for ordinary walking or for the practice of a specific sport.

In general, in this type of shoe, the toecap and the heelpiece, as well as the side walls, are structured in fabrics, while the sole and the welt are made of plastics, rubber or similar material according to the use the shoe is put to.

The important thing in a sport shoe is that the sole be made of an antislipping, extremely flexible and highly wear resistant material so as to allow the wearer to move , with great comfort but at the same time with enough firmness, such as if it constituted an extension of his own foot; the wear resistance factor being a requisite arising from the need of counterbalance the great endeavors to which the shoe is subjected during the practice of a sport and also the grinding effect of the ground, the torsions and the sudden warping caused by the instant non conventional positions of the foot, etc.

The state of the art on the subject may be summarized as follows: for a long time there has existed, as an example of this sort of shoe, the one with a rubber sole or of similar material, commonly termed "rubber slipper". In such a shoe, the rubber sole is adhered to the toecap and to the heelpiece—generally of fabrics—by means of a welt surrounding the shoe containing the virtual plane of the foot rest.

Later on, with the advent of the new technology on the treatment of plastic materials such as rubber (natural or synthetic), expanded PVC, etc., the production of a microporous material has been achieved. At the very beginning such material was used applied to the shoe as the insole thereof replacing the traditional leather, fabrics or resilient insoles, the structures of which were not microporous.

If it may be supposed that microporous insoles—of a thickness of about 2 or 3 mm—offer a more cushioned gait or stride, it is not so because the body weight is unevenly distributed on the sole of the foot. The metatarsus and the ankle regions receive the weight of the body, producing a load that presses the corresponding zone of the microporous material and the microporous material is compressed until it becomes virtually rigid due to the compression to which the same is subjected when the weight of the body is transferred to the foot resting on the floor. This fact, not only causes disturbances or discomfort to the wearer but also alters the suitable pronation control (that is, the control of the foot joint for a correct alignment) granted by the manufacturer while developing the sole.

Moreover, one of the most important questions to be taken into account is that of preserving the maintenance or support of the foot arch—which tends to be bended by its proper weight and the development of certain activities such as the sports, all of which favours the distortion known as "flat foot" and the inconveniences derived therefrom ; the manufacturers of the prior art sport shoes have tested some improvements such as the incorporation of inner leather strips used to build up the sole of the shoe and other supplements which might serve as a resting or support means for the arch.

Those efforts could have been a positive development on the subject of improved sport shoes if it weren't for the practice which showed that the presence of such elements which were intended to maintain the foot arch, were inadequately combined with conventional insoles and became a prejudicial factor since the ir presence constituted or caused a hardness or a comb in the insole which did not favour or improve the situation; on the contrary such elements resulted in a serious disturbance or discomfort for the wearer, harming his foot in such a way that the wearer ended up rejecting the shoe provided with said combs.

Another question to take into account is that sport shoes and slippers normally lack a heel—because of the weight problem and the expense derived from the excess of the material employed,—the trend being that of creating a shoe having a greater in the heel height region than in the plantar region in order to avoid an alteration in the human body memory with respect to the habit of wearing the traditional shoes wherein the back portion is lifted or raised in relation to the front portion, due to the presence of the outer heel. Thus with the rejection of the shoe not fulfilling such a condition is also avoided.

At present, the sport shoes or the slippers wherein the thickness is greater in the heel than in the toecap, form reticulate cells or holes, intended to allow a saving on the materials employed and to reduce the sole weight. The same have the disadvantage of defining therebetween regions of little surface forming ribs or combs which are very harmful for the foot; even the traditional insoles employed do not separate enough the foot from said combs and so the body weight, distributed between the ankle and the plantar region, bends the standard insoles and the presence of the ribs or discontinuous surface created by the cells are felt by the foot of the wearer as if there were no insole separating it, such insole being wholly inefficient and producing blisters and callosities.

The rule recited by the specialists which indicates that "if a shoe is not appropriately fitted to the foot anatomy, this foot tends to fit the shoe structure with an awful end, as it happens with everything contrary to the nature", is inexorably fulfilled.

Some manufacturers have also intended to supply the shoes with some resilient cushions of greater thickness and adequate shape, such as is the case with the orthopedic cushions and insoles incorporated in the shoe. These only serve to translate the disturbance position since, by reducing the cavity or space lodging or housing the foot, the foot becomes pressed against the inside toecap face. This problem is known to those who have ever tried to introduce anatomic or orthopedic insoles in a shoe whatsoever, and so it is useless to speak thereabout. It must only be said that insoles made of conventional microporous material are poorly tensile resistant or poorly resistant to the different endeavors or distortions to which they are subjected when used in sport shoes, as compared to the known soles of non microporous material, all of which constitutes a negative factor even more in these conventional systems.

The sport shoe without the microporous sole is manufactured by placing the last, to which the toecap and heelpiece are fixed, into an injection mold having a cavity for forming the sole and the welt of the shoe when the plastic and heat-setting material is press-injected into the mold.

In turn, the microporous sole for the sport shoe is manufactured from a rubber foil or sheet subjected to a physical and chemical process resulting in the microporous structure formation with a thickness stated in 7 mm., after which the soles are cut to the predetermined size are then are glued to the toecap and the heelpiece on the corresponding last.

That is to say that heretofore, a sport shoe having the characteristics of flexibility and resistance to the plastic soles, such as aforesaid, as well as giving the comfort of microporous material soles, has not been achieved.

Moreover and as indicated by the manufacturing conventional processes before described, it is not possible to combine the same and they only serve for the specific and limited purposes already known, resulting in the inconvenience also above recited.

The mere solution to said problem would seem obvious by adding to the ordinary shoes an insole of microporous plastic material with thicknesses greater than 7 mm, all of which is not possible since said supplement reduces the shoe capacity to lodge the foot volume it was designed for. That is, if for example, the shoe was designed for a number 40 foot, the volume corresponding to number 40 foot last cannot be reduced by adding a 7 mm or thicker sole, since it would not allow the introduction of a foot corresponding to number 40 last.

Even though it could be said that said shoe might be used for a foot of smaller last—such as number 38 last—but it is not so because the reduction on the lodging capacity is done only in the cross-sense and not in the longitudinal sense and then the shoe thus produced will not fit a volume whatsoever of usual lasts and the disproportion more harmful would be that corresponding to a shoe length not adequate for such a small foot.

The subject invention described in this specifica tion resides in the combination of three essential characteristics to solve all problems outlined:

(a) The sole, being thicker in the heelpiece becomes gradually thinner to the plantar region and beneath said region of thickness greater than the plantar area, forms open cells becoming minimum bearing surfaces, thus reducing the shoe weight and the cost of the materials employed, with the particularity that in the shank area, said combs (which for example may correspond to crossed ribs) form a support bridge for the foot arch, the forming capacity of said bridge being adapted to the anatomy thereof.

(b) On this inside sole surface there is a resilient micro-cellular material layer, of relatively high thickness (at least 7 mm), lined by an insole. In one of the preferred embodiments, this resilient micro-cellular material presents an specific weight of 0,306 g per cubic centimer, which, on a compression-deflection test done loading three specimens 7,81 $cm^2$ each, which 20 force kg, 40 force kg and 100 force kg, respectively, and then unloading the same to 0 force kg, did not show any permanent strain in either of the three specimens thus tested.

(c) The standard volume of the last conforming the shoe size is designed greater than the standard foot volume but only in the plane defined by the virtual foot bearing, the height thereof being substantially higher than the sole with the higher part of the microcellular resilient material layer and the lining insole. In other words, the shoe last has a volume that, in addition to the pre-stated volume for lodging the foot, increases its height only in the sense defined by the virtual foot bearing, in a magnitude corresponding to the whole sum of the thicknesses of the microcellular resilient material layer and its lining insole, such that, although the microcellular material and its insole thickness has been increased, the foot lodging capacity of the shoe, according to the pre-stated number in each case, does not vary.

(d) Additionally, the shoe welt has a height such that its higher edge reaches at least the higher face of the micro-cellular and resilient material layer, boxing or encasing the same and permanently assuring its operative position; nevertheless it has been devised, as an alternative of the embodiment, that said edge be higher than said higher face through a greater length and so the boxing may comprise the whole foot.

Accordingly, the new sport shoe gathers the characteristics of flexibility and resistance required which, upon being combined, make said shoe extremely light without altering the wearer anatomic memory with respect of varying conventional thicknesses; it bears adequately the foot arch favouring the maintenance thereof and offers a comfort like a cushioned effect characteristic of the microporous sole shoes with the particular isolation offered by the microcellular material layer which prevents the foot from feeling the inside combs of the sole which finally harm the same as it happens with the conventional systems already described.

Comparing the invention to patented embodiments on the subject, the following United States Patents and the differences thereof with respect of this invention are next indicated, to wit:

U.S. Pat. No. 4,128,950: it discloses a shoe structure comprising an outside sole layer (12) (FIG. 1) made of wear resistant and flexible rubber, a sole layer lifting the heelpiece (14) made of cushioned, foamy, plastic, synthetic, light and resilient material and an intermediate sole layer (16) of similar foamy and plastic material. Layers (14 and 16) are made of foamy, plastic, synthetic, closed cell and resilient material, polyethylene or polyethylene vinyl acetate. It neither forms open cells nor a plantar arch support in the shank area characteristic (a); it does not have the microcellular insole in the proportion and with the characteristics already mentioned in (b) and volumetric compensation of characteristic (c) has not been devised.

U.S. Pat. No. 4,449,306: It disclosed a shoe structure comprising a relatively thin outside sole layer (5), a heelpiece sole layer (4) and a midsole (3) (FIG. 1); while the outside sole (5) is made of a wear resistant material, the midsole (3) and the heelpiece sole layer (4) are made of a cushioned and resilient material, such as light synthetic foam. That is, except for the fact that there is a variation in the thickness to the heelpiece, neither characteristic (a) nor characteristic (b) is contemplated in the proportions indicated; the volume compensating variation of characteristic (c) is neither contemplated.

U.S. Pat. No. 4,245,406: Outside sole (12) is adhered to midsole (14) formed by a polyurethane adhered to insole (16) and to the upper (18) and forms cavities with ribs making it lighter; it lacks of the arch support characteristic (c); it neither has the microcellular layer in the proportion indicated in characteristic (b) nor the volumetric compensation of (c).

U.S. Pat. No. 4,377,041: It presents none of the characteristics (a), (b) or (c).

U.S. Pat. No. 4,307,521: It has cavities but to the zone nearer the sole; it does not have plantar arch support characteristic (a); the presence of the microcellular layer has not been devised in the shape and in the proportions indicated in characteristic (b); the volumetric compensation of characteristic (c) is neither contemplated.

U.S. Pat. No. 4,455,767: It has cells but it forms a heelpiece and lacks of the characteristics (a), (b) and (c).

U.S. Pat. No. 3,971,145: It discloses a sport shoe sole for the practice of tennis. There is no relation with the subject invention because it lacks of the characteristics (a), (b) and (c) thereof.

U.S. Pat. No. 2,100,492: There is no gradual variation of the sole thickness; it lacks of cavities and the plantar arch support; the characteristic (b) and (c) have not been devised.

For the sake of clarity and understanding of the object of the present invention, it is illustrated by means of figures, wherein the same has been shown in some of the preferred embodiments, all this to illustrate and not to limit the invention, wherein:

FIG. 1 is an inner-side perspective view of the sole surrounded by the welt, with cross-section in the toecap, the microcellular material and the insole of the new shoe, wherein inner ribs defining therebetween cells intended to make the shoe lighter and to reduce costs have been shown, including certain ribs in the shank area which form a bearing bridge for the foot arch.

FIG. 2 is a detailed sectional view of the shoe according to the invention wherein the welt has a height such that its edge is higher than the upper plane level of the microcellular cushion, outer sole and welt boxing or encasing the same and the foot.

FIG. 3 is another detailed sectional view of the shoe but in an embodiment according to which the height of the welt is such that its upper edge level is approximately equal to -or lower than- the foot supportting plane of the insole; in that way it does not box or encase the same, as it does in the embodiment in FIG. 2, although it boxes or encases the microcellular cushion and its insole.

Figure 4:
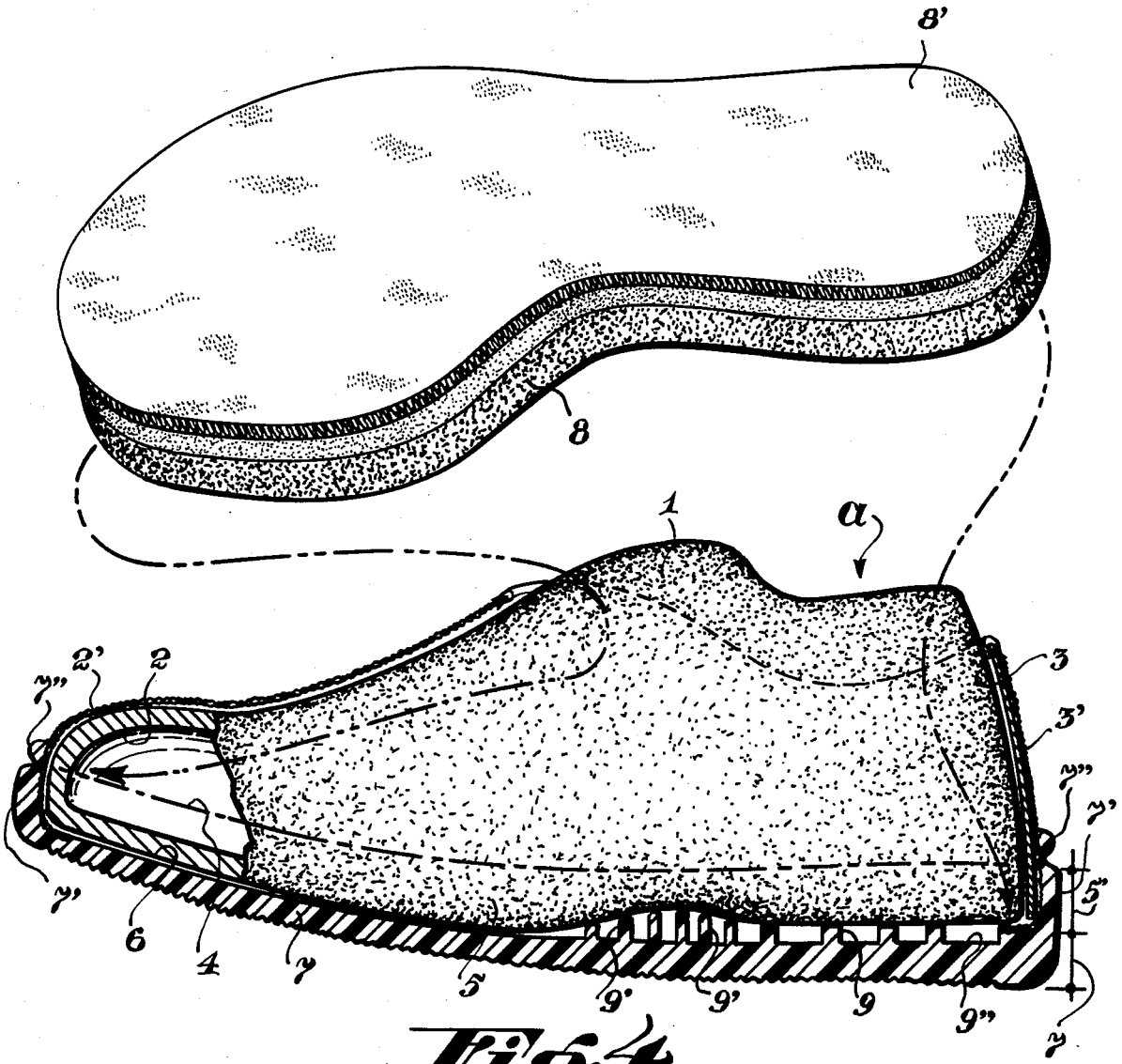
FIG. 4 is a perspective view of the resilient insole and of the shoe of the invention made on the last and showing the cavity for receiving the insole therein with portions of the toe section and of the arch and heel support sections cut away.
Figure 5:
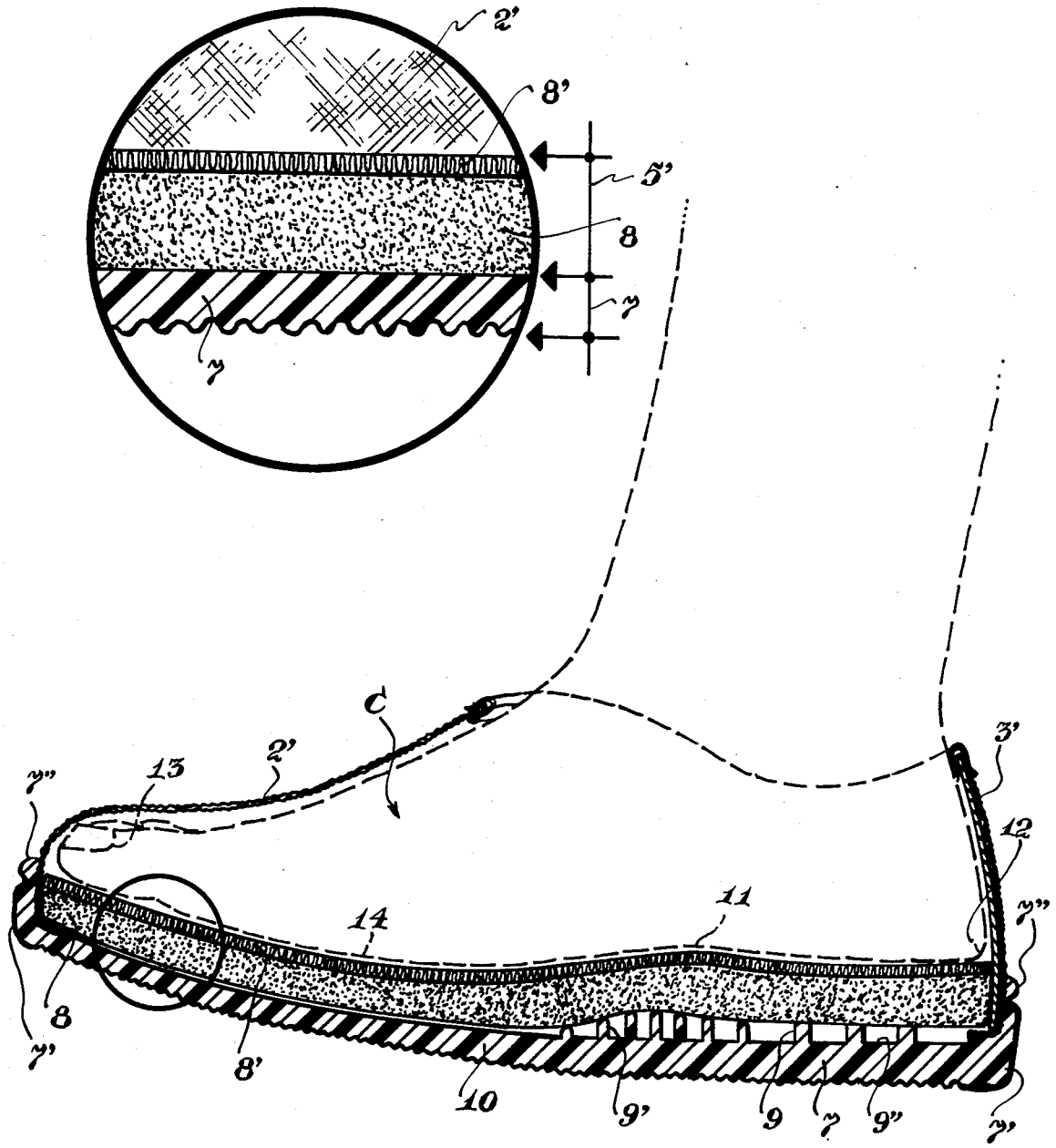
FIG. 5 is a longitudinal sectional view of the shoe of the invention showing an enlarged portion of the section near the toe of the shoe .

FIG. 4 is a longitudinal section of the shoe and its last wherein its general construction and the arrangement of the different components can be appreciated. The extension of the shoe last past its bounderies in the sense that it extends past the foot support plane of the shoe to define the volume of the space to be occupied by the microcellular cushion of a thickness greater than the sole, can be seen in FIG. 4 and be seen in more detail in FIG. 5; The shoe last is shown as a longitudinal line of discontinuous strokes, which, besides corresponding to the normal position of the conventional last, defines portion a from which said last increases its thickness in such a magnitude as to form the cushion receptacle for the cushion to be secured to the inner surface of the sole. From FIG. 4 one can also be appreciated how the shoe is made in its component parts, from particularly in the perspective view of the microcellular cushion and its insole which can be inserted into the shoe after the last is removed as indicated by the arrows in the additional receptacle or cavity formed by the last therefor; and FIG. 5 is another longitudinal section of the shoe in the normal wear conditions wherein the way in which the cushion fits the anatomic shape of the foot is shown; both details show, surrounded by circles, the sole layers and the cushion on one hand, and the shank area bridge constituting the foot arch support, on the other hand.

In the different figures, like reference numerals show like or corresponding parts, the groups of elements being indicated by means of letters.

Said references correspond to the following description, wherein:

a - last
b - shoe
c - foot
1 - last body
2 - last upper
2'- shoe toecap
3 - last heelpiece
3'- shoe heelpiece
4 - conventional last normal base
5 - last additional height
5'- cushion-holder receptacle, formed by 5
6 - last base
7 - sole
7'- welt
7''- higher edge of the welt
8 - micro-porous, resilient cushion, to be lodged in 5'
8'- insole lining 8
9 - ribs of 7
9'- shank area bridge (foot arch support)
9''- cavities or cells formed between 9
10- shank area
11- foot arch
12- ankle
13- foot toe
14- foot sole In general terms and as seen in FIG. 4, a is the shoe last, which, being made of appropriate metal or of similar material, presents the classical configuration comprising the body (1), the upper (2), the heelpiece (3) and the base (4). The toecap 2', together with the rest of the shoe body b and the heelpiece (3'), are completed on the last with the sole (7) surrounded by welt (7') ending at the higher edges (7'') of the welt.

Now then, in this particular situation, the volume of normal last a (in conventional lasts, it would end at line (4), FIG. 4) constituting or defining the inner size or space of shoe b, is extended past the boundaries of said normal volume, i. e. past the base (4) defined by foot support virtual plane c (see FIGS. 4 and 5). The height thereof or the distance beyond base (4) which the last extends is being at least 7 mm and substantially greater than the height of the proper sole (7) (FIG. 5, in detail); the virtual plane or base (4) matches or corresponds to the upper face of a micro-porous resilient material layer (8) filling said additional volume (5') formed by the last (FIGS. 4 and 5).

Figure 2:
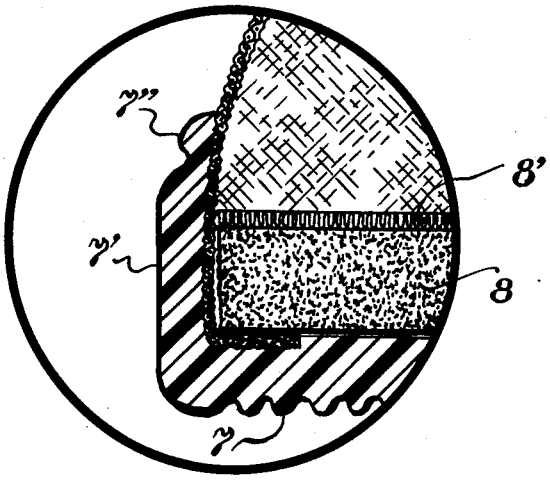
FIG. 2 is an enlarged partial sectional view along one edge of the shoe of the invention.
Figure 3:
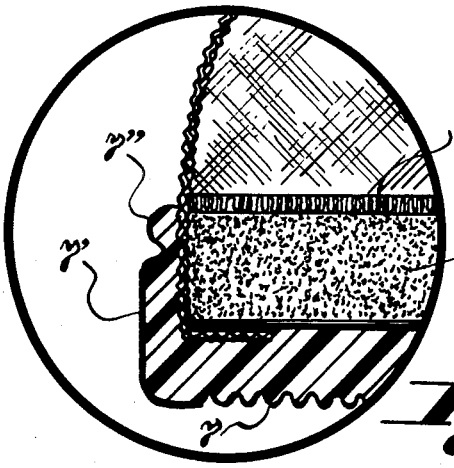
FIG. 3 is an enlarged partial sectional view along one edge of another embodiment of the shoe of the invention.

The side welt (7') of shoe b has a height such that the higher or upper edge thereof (7'') extends past the lower plane of cushion-holder receptacle (5') and can be matched approximately to the height of the microporous material layer (8) and its insole (8') (FIG. 3) or it may be higher than the same (FIG. 2), in the latter case additionally partially boxing or encasing foot c .

Figure 1:
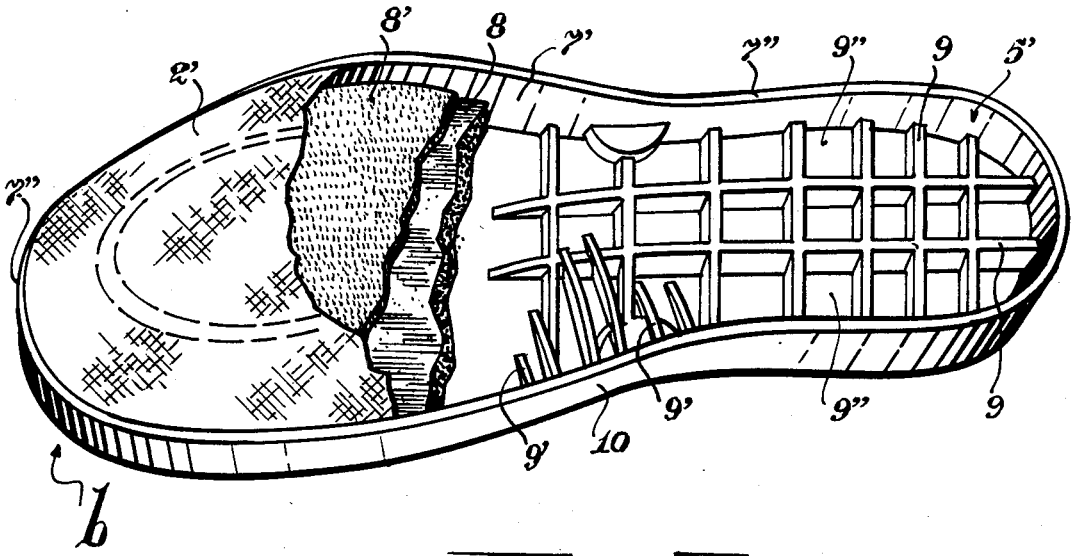
FIG. 1 is a top perspective view of the outer sole of the shoe of the invention with portions cut away to show the arch and heel support structure for the insole.

In order not to alter the anatomic memory of the wearer with respect to the shoe traditional difference made, the sole is in height of between the sole and heel of the shoe thicker at the heelpiece region (3) as if it were a heel, while gradually reducing said height to ward the plantar region by means of ribs (9) forming cavities, cells or holes therebetween (9'') which are intended to make the shoe lighter and to achieve materials savings in the production thereof (FIG. 1).

In the shank area (10), that is where the sole and the shoe as a whole are inside narrowed- ribs (9) are completed by combed ribs (9') (FIGS. 1 and 4) forming a combed bridge intended to give support to foot c arch (11) (FIG. 5) . The combed bridge is therefore extended to a height higher than the rest of the ribs (9) (FIGS. 1, 4 and 5).

Microcellular material (8), of at least 7 mm., in the shape of a cushion, may be placed in receptacle or cavity (5'), free or preferably adhered to the inside surface of sole (7) such that it constitutes a soft, smooth and extremely comfortable support for foot c, when the toe (13) of the foot is fitted inside the toecap (2') toepiece and the plantar region (14) of the foot is fitted onto the relevant part of cushion (8) and insole (8') corresponding to the sole (7) plantar region; its heelpiece (12) is fitted to the shank area (3') over cushion (8), said heelpiece being supported by ribs (9) and said arch (11) being supported on bridge (9') without any trouble and with the maximum comfort offered by the resilience of cushion (8) also lined by insole (8') (FIG. 5).

Undoubtedly, this invention, when put into practice, may be subject to certain modifications in relation to the construction and the shape of the new and improved shoe, without departing from the main principles stated in the following claims:

Having thus described and stated the nature of this invention as well as the way in which the same may be put into practice, the following is claimed as of exclusive right and property:

1. In a sports shoe comprising a shoe body having a toe cap (2'), a heel portion (3') and a shank area wherein said shoe body is secured to an outer sole (7) formed of flexible, resilient and wear resistant material by a welt (7') extending about said shoe body the improvement wherein said outer sole has a wall portion extending upwardly about its outer peripheral edge and defining a cavity within said outer sole, said sole having an outer thickness at the heel of said shoe, said thickness gradually decreasing to about the shank area of said shoe, a network of spaced ribs integral with said outer sole and extending from the back of said cavity toward the front of said cavity to the plantar region of said sports shoe, said spaced ribs defining individual cells or cavities (9'') in said outer sole, said spaced ribs defining a first bearing surface, a plurality of separate spaced ribs (9') integral with said outer sole and disposed at the shank area of said sport shoe and defining a second bearing surface, said plurality of separate, spaced ribs extending to a height greater than the height of the ribs in said network of spaced ribs, said height of said plurality of separate spaced ribs being sufficient to support the arch of the wearer of the sports shoe, a microporous, resilient cushion layer (8) having a thickness of at least 7 mm disposed upon and supported by said first and second bearing surfaces and by the forward portion of the surface of said outer sole cavity, and an insole lining (8') adhering to the upper surface of said cushion layer.

2. The sport shoe defined by claim 1 wherein said welt (7') has a height such that its upper edge is at least as high as the upper surface of said microporous cushion layer within said shoe.

3. The sports shoe as defined in claim 1 wherein a number of said spaced ribs in said network of spaced ribs extend along the longitudinal axis of said outer sole and the remainder of said spaced ribs are substantially perpendicular to said longitudinally extending ribs.

4. The sports shoe as defined in claim 3 wherein the height of said longitudinally spaced ribs tapers downwardly to the surface of said outer sole as said ribs approach the plantar region of said shoes.

5. The sports shoe as defined in claim 3 wherein said plurality of separate spaced ribs disposed at the shank area of said sports shoe extend inwardly in a forward direction of said insole and at an acute angle to said longitudinally extending ribs.

* * * * *